United States Patent [19]

Carlton

[11] 4,026,559

[45] May 31, 1977

[54] JIGSAW PUZZLE BOARD

[75] Inventor: Joe D. Carlton, Greenville, S.C.

[73] Assignee: The Raymond Lee Organization, Inc., New York, N.Y. ; a part interest

[22] Filed: Nov. 17, 1975

[21] Appl. No.: 632,443

[52] U.S. Cl. ..... 273/157 R; 211/131

[51] Int. Cl.[2] ..... A63F 9/00

[58] Field of Search ..... 273/157 R, 136 Z, 148 R, 273/148 A; 211/53, 56, 70, 58, 77, 78, 95, 129, 163, 131

[56] References Cited

UNITED STATES PATENTS

| | | | |
|---|---|---|---|
| 462,933 | 11/1891 | Sanderson et al. | 273/136 Z |
| 676,639 | 6/1901 | Stroud | 273/136 Z |
| 2,003,845 | 6/1935 | Whitcomb | 273/157 R |

*Primary Examiner*—Anton O. Oechsle

*Attorney, Agent, or Firm*—Howard I. Podell

[57] ABSTRACT

A board on which to assemble a jigsaw puzzle. The board is preferably of circular form and fitted with an inner rectangular section bounded by upraised ridges in which section the puzzle is assembled. The outer section of the board is formed with a pair of separated concentric upraised ridges, with a ring-shaped tray loosely fitted on the board between the concentric ridges on which the puzzle pieces may be initially placed in random order. The tray may be rotated so as to bring any desired puzzle piece to the position of the player, without rotating the position of the partially assembled jigsaw puzzle resting in the inner rectangular section. Vertical pegs may be mounted to extend above the tray surface to furnish grip means for manually rotating the tray.

1 Claim, 4 Drawing Figures

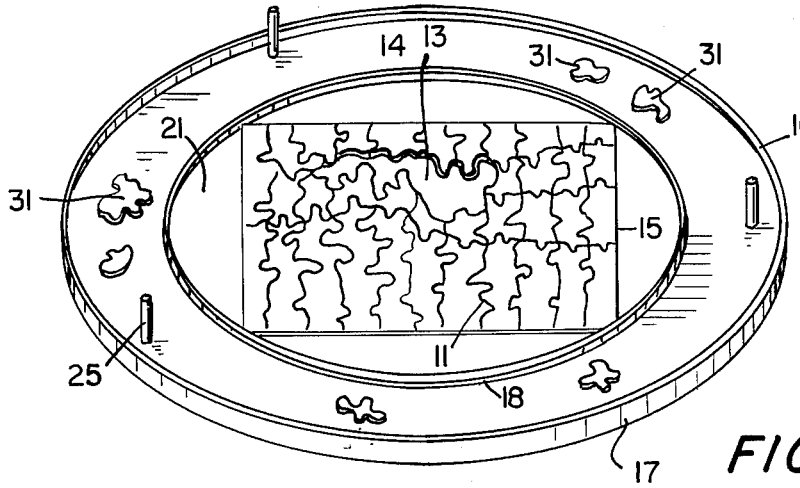
FIG. 1
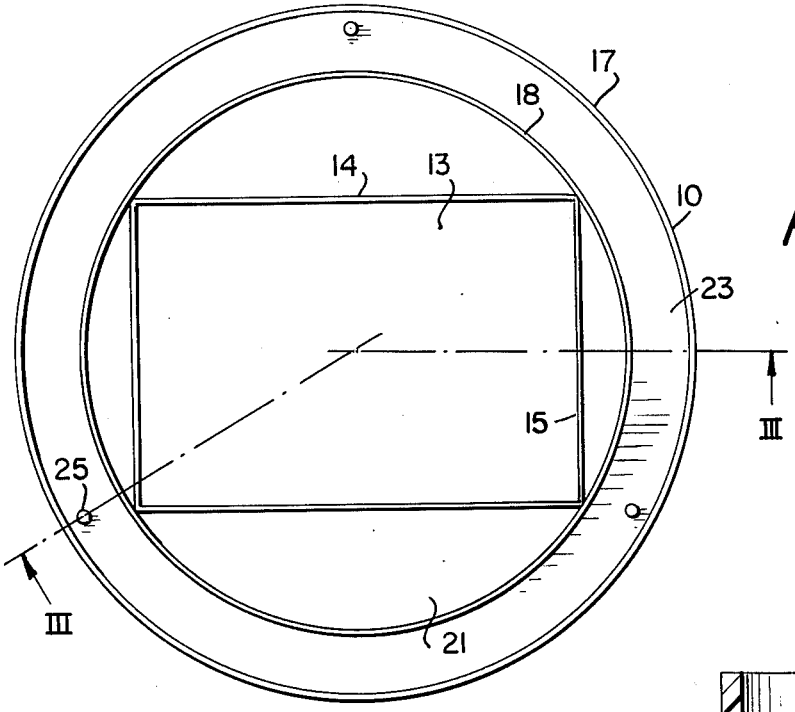
FIG. 2
FIG. 4
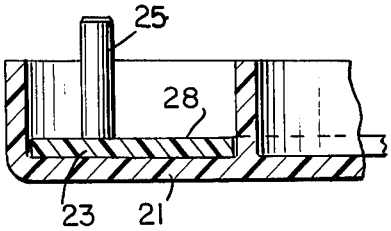
FIG. 3
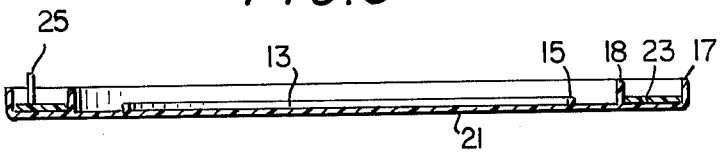

JIGSAW PUZZLE BOARD

SUMMARY OF THE INVENTION

My invention is a board on which to assemble a jigsaw puzzle. The board is preferably of circular form and fitted with an inner rectangular section bounded by upraised ridges in which section the puzzle is assembled. The outer section of the board is formed with a pair of separated concentric upraised ridges, with a ring-shaped tray loosely fitted on the board between the concentric ridges on which the puzzle pieces may be initially placed in random order. The tray may be rotated so as to bring any desired puzzle piece to the position of the player, without rotating the position of the partially assembled jigsaw puzzle resting in the inner rectangular section. Vertical pegs may be mounted to extend above the tray surface to furnish grip means for manually rotating the tray.

Use of my invention by invalids and the bedridden would simplify the task of sorting and locating a desired jigsaw puzzle piece when assembling such a puzzle.

BRIEF DESCRIPTION OF THE DRAWINGS:

The objects and features of the invention may be understood with reference to the following detailed description of an illustrative embodiment of the invention, taken together with the accompanying drawings in which:

FIG. 1 is a perspective view of the invention is use;

FIG. 2 is a plan view of the invention;

FIG. 3 is a sectional view of the invention, taken along line III—III of FIG. 2; and FIG. 4 is a fragmentary enlarged sectional view of FIG. 3.

DESCRIPTION OF THE PREFERRED EMBODIMENT

Turning now descriptively to the drawings, in which similar reference characters denote similar elements throughout the several views, FIG. 1 illustrates the Puzzle Board 10 with a partially assembled jigsaw puzzle 11 resting on the board platform 21 and fitted in the rectangular shape of interior section 13 of the circular board 10. Upraised ridges 14 and 15 extend from platform 21 to bound the interior section 13. An upraised ridge 17 forms the external rim of the board 10 and a concentric inner ridge 18 is mounted to the platform 21 uniformly spaced from rim ridge 17 of the platform 21.

A circular tray 23 of a size to loosely fit between concentric ridges 17 and 18 rests on platform 21. A plurality of pegs 25 extend from the upper surface 28 to furnish manual gripping means for rotating tray 23 to bring a specific jigsaw puzzle piece 31 lying on the tray to the position of the player. It is to be noted that rotation of the tray does not cause rotation of the inner section 13 on which the partially assembled puzzle rests. Alternately, the ridges 14 and 15, which bound interior section 13, may be fixed to a circular shaped board (not shown) which rests on the platform 21 within interior circular ridge 18 so that the partially assembled puzzle 11 is independently rotatable.

Since the obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A board on which a jigsaw puzzle may be assembled, comprising a platform, the top surface of which is fitted with a pair of concentric circular upraised ridges uniformly spaced from each other that are each fixed to the platform, with the inner circular ridge enclosing a central area of the platform on which a jigsaw puzzle may be assembled, a ring shaped tray of a size to fit between the circular ridges, said tray freely resting on the top surface of said platform with said tray being freely rotatable with respect to the platform, and with said circular ridges being spaced apart by a distance to permit pieces of a jigsaw puzzle to rest on the tray, in which the tray is fitted with gripping means extending from the top surface of the tray, together with a set of upraised ridges mounted to the platform in the central area of said platform, said set of ridges serving as borders of an area in which a jigsaw puzzle may be assembled.

* * * * *